US011208797B1

(12) United States Patent
Estry

(10) Patent No.: US 11,208,797 B1
(45) Date of Patent: Dec. 28, 2021

(54) OVERFLOW PREVENTION SYSTEM

(71) Applicant: Jonathan Estry, New Bern, NC (US)

(72) Inventor: Jonathan Estry, New Bern, NC (US)

( * ) Notice: Subject to any disclaimer, the term of this patent is extended or adjusted under 35 U.S.C. 154(b) by 0 days.

(21) Appl. No.: 16/936,539

(22) Filed: Jul. 23, 2020

(51) Int. Cl.

| | |
|---|---|
| ***E03D 1/26*** | (2006.01) |
| ***E03D 5/02*** | (2006.01) |
| *E03D 1/34* | (2006.01) |
| *E03D 5/10* | (2006.01) |

(52) U.S. Cl.
CPC ..... *E03D 5/026* (2013.01); *E03D 1/266* (2013.01); *E03D 1/34* (2013.01); *E03D 5/105* (2013.01)

(58) Field of Classification Search
CPC ..... E03D 5/026; E03D 1/266; E03D 1/34; E03D 5/105
See application file for complete search history.

(56) References Cited

U.S. PATENT DOCUMENTS 5,062,166 A 11/1991 Krenecki
5,400,446 A * 3/1995 Bloemer ..... E03D 5/04 4/250
6,016,577 A * 1/2000 Cooley ..... E03D 1/00 4/427
6,151,724 A * 11/2000 Klingenstein ..... E03D 1/14 4/323
6,178,569 B1 * 1/2001 Quintana ..... E03D 1/00 4/427
6,671,894 B1 1/2004 Sigrist
6,934,977 B1 8/2005 Quintana
10,900,212 B1 * 1/2021 Ben Shoshan ..... E03D 1/306
2006/0242756 A1 * 11/2006 Fields ..... E03D 11/00 4/427
2007/0245475 A1 * 10/2007 Goldman ..... E03D 1/34 4/378
2013/0247292 A1 * 9/2013 Jefferson ..... E03D 11/00 4/427

* cited by examiner

*Primary Examiner* — Erin Deery

(57) ABSTRACT

An overflow prevention system includes a toilet that has a tank, a flapper and a bowl. A closure unit is positioned in the tank of a toilet and the closure unit is aligned with the flapper in the toilet tank. The closure unit engages the flapper when the closure unit is turned on to inhibit the flapper from opening. In this way the closure unit can inhibit the toilet from overflowing when the toilet is flushed. A pair of conductors is each positioned in the bowl and each of the conductors is exposed to water when the bowl of the toilet becomes filled with water. The conductors are in electrical communication with the closure unit and the closure unit is turned on when a circuit is completed between the exposed ends of the conductors. Thus, the closure unit inhibits the bowl of the toilet from overflowing when the toilet is flushed.

6 Claims, 4 Drawing Sheets

OVERFLOW PREVENTION SYSTEM

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to overflow devices and more particularly pertains to a new overflow device for inhibiting a toilet from overflowing.

(2) Description of Related Art Including Information Disclosed Under 37 CFR 1.97 and 1.98

The prior art relates to overflow devices including a float that is pivotally mounted in a bowl of a toilet and a closure in tank of the toilet for inhibiting the toilet from overflowing. The prior art discloses a flow control device that includes a pair of water sensors each positioned in a bowl of a toilet that inhibit the toilet from flushing when the water sensors sense water. The prior art discloses an electronic valve in a tank of a toilet and a water sensor in a bowl of the toilet which closes the electronic valve when the water sensor senses water. The prior art discloses an overflow device that includes a valve that is fluidly coupled to a water supply of a toilet for inhibiting the toilet from overflowing.

(h) BRIEF SUMMARY OF THE INVENTION

An embodiment of the disclosure meets the needs presented above by generally comprising a toilet that has a tank, a flapper and a bowl. A closure unit is positioned in the tank of a toilet and the closure unit is aligned with the flapper in the toilet tank. The closure unit engages the flapper when the closure unit is turned on to inhibit the flapper from opening. In this way the closure unit can inhibit the toilet from overflowing when the toilet is flushed. A pair of conductors is each positioned in the bowl and each of the conductors is exposed to water when the bowl of the toilet becomes filled with water. The conductors are in electrical communication with the closure unit and the closure unit is turned on when a circuit is completed between the exposed ends of the conductors. Thus, the closure unit inhibits the bowl of the toilet from overflowing when the toilet is flushed.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
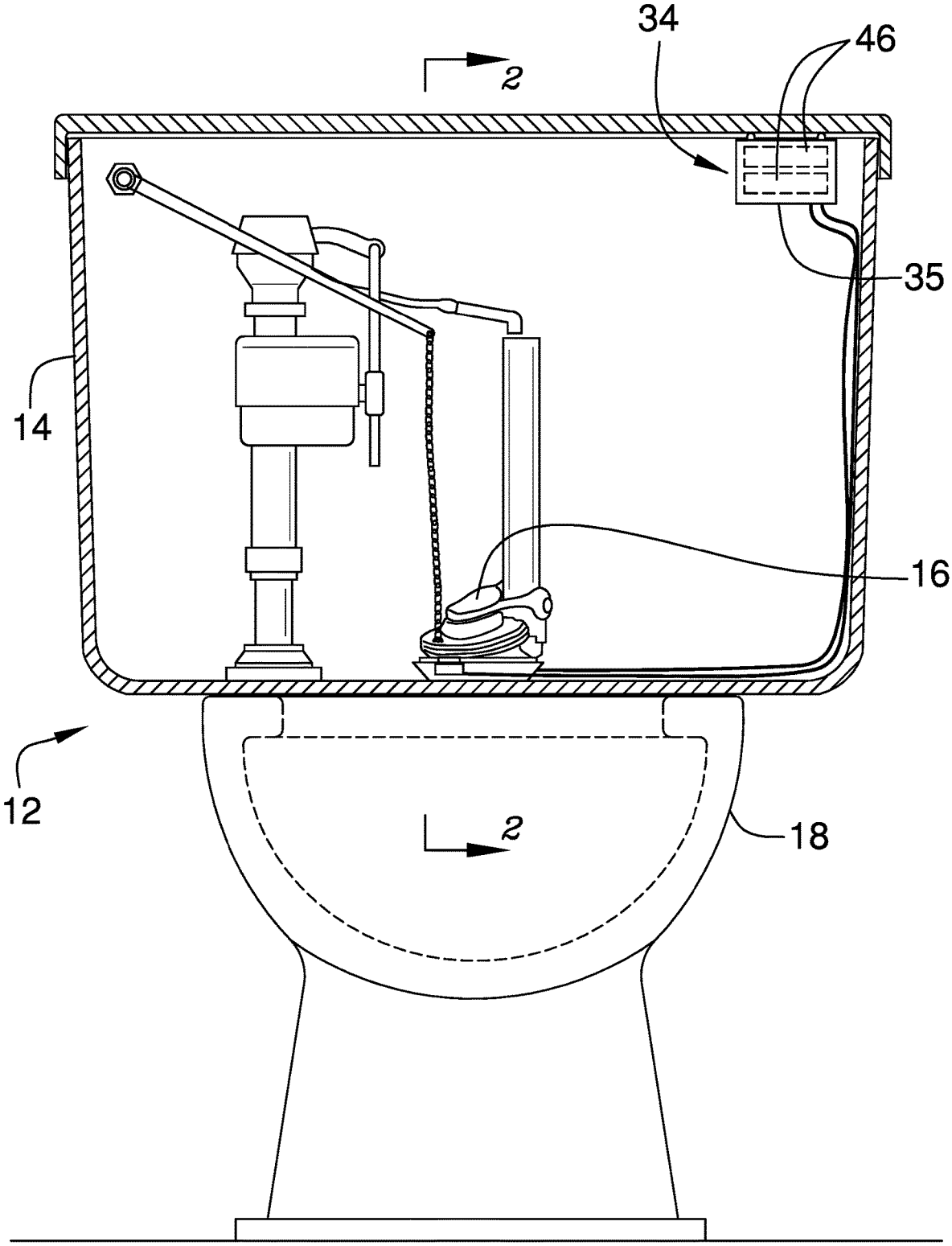
FIG. 1 is a front cutaway view of an overflow prevention system according to an embodiment of the disclosure.
Figure 2:
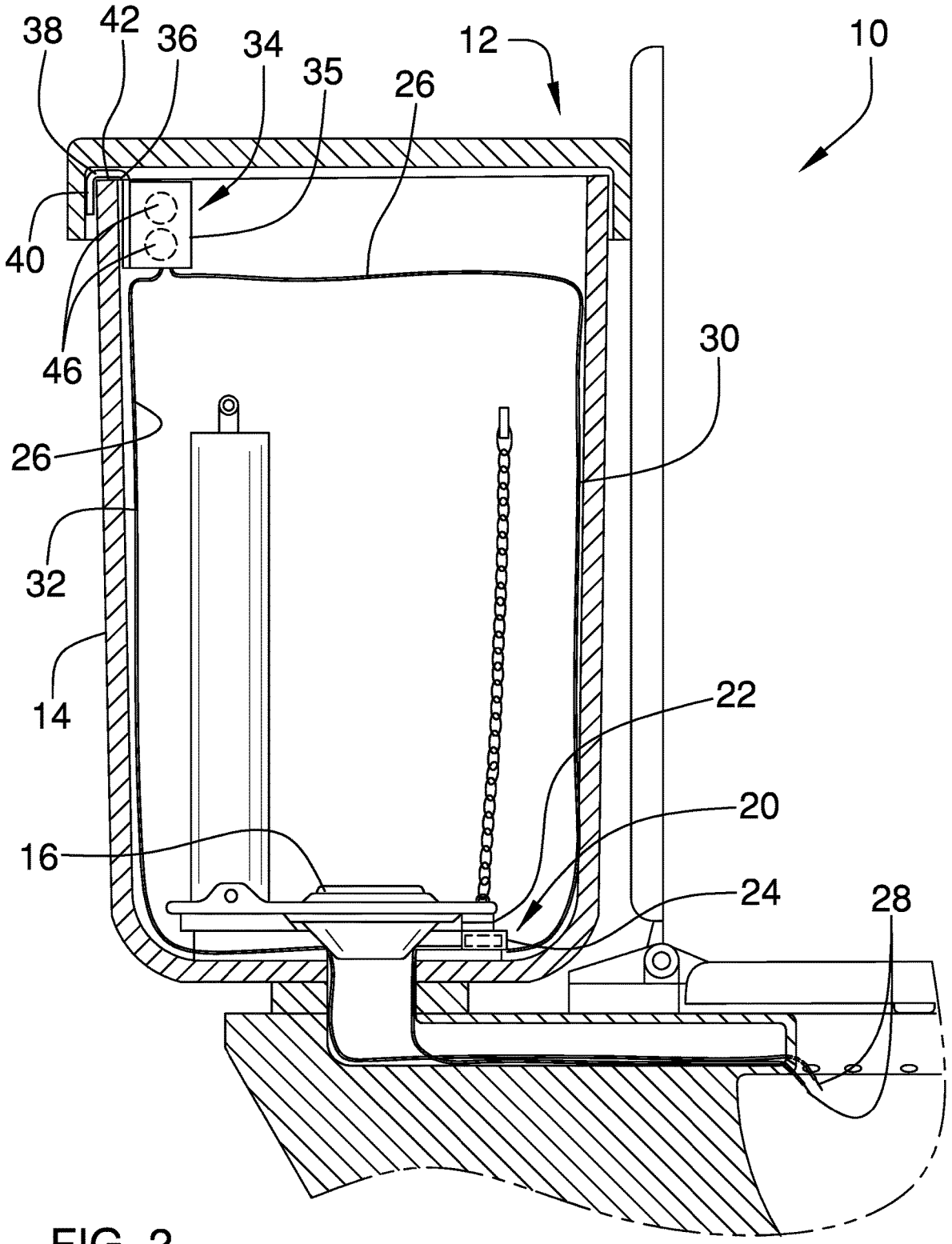
FIG. 2 is a cross sectional view taken along line 2-2 of FIG. 1 of an embodiment of the disclosure.
Figure 3:
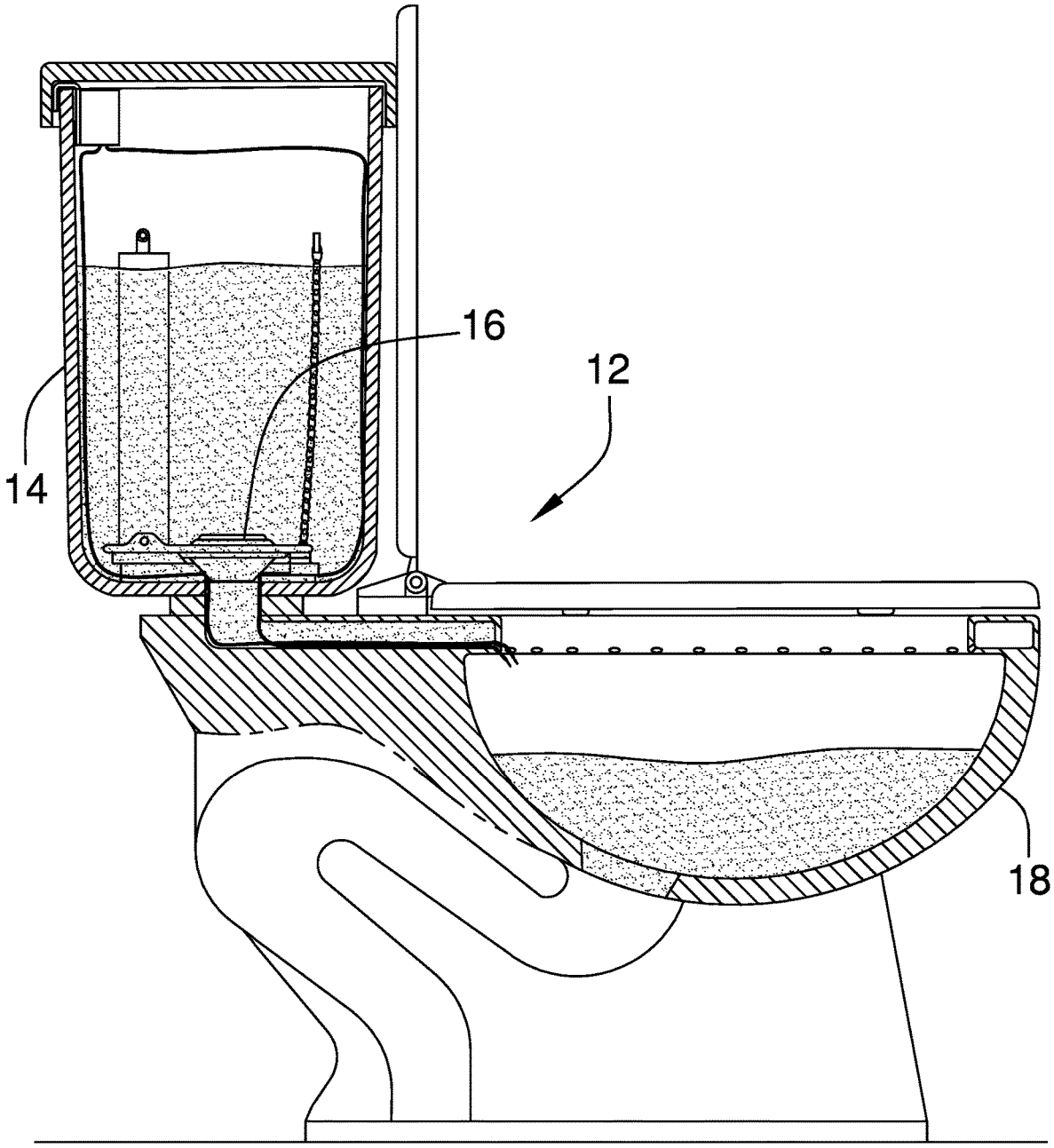
FIG. 3 is a right side cut-away view of an embodiment of the disclosure showing a toilet being available to be flushed.
Figure 4:
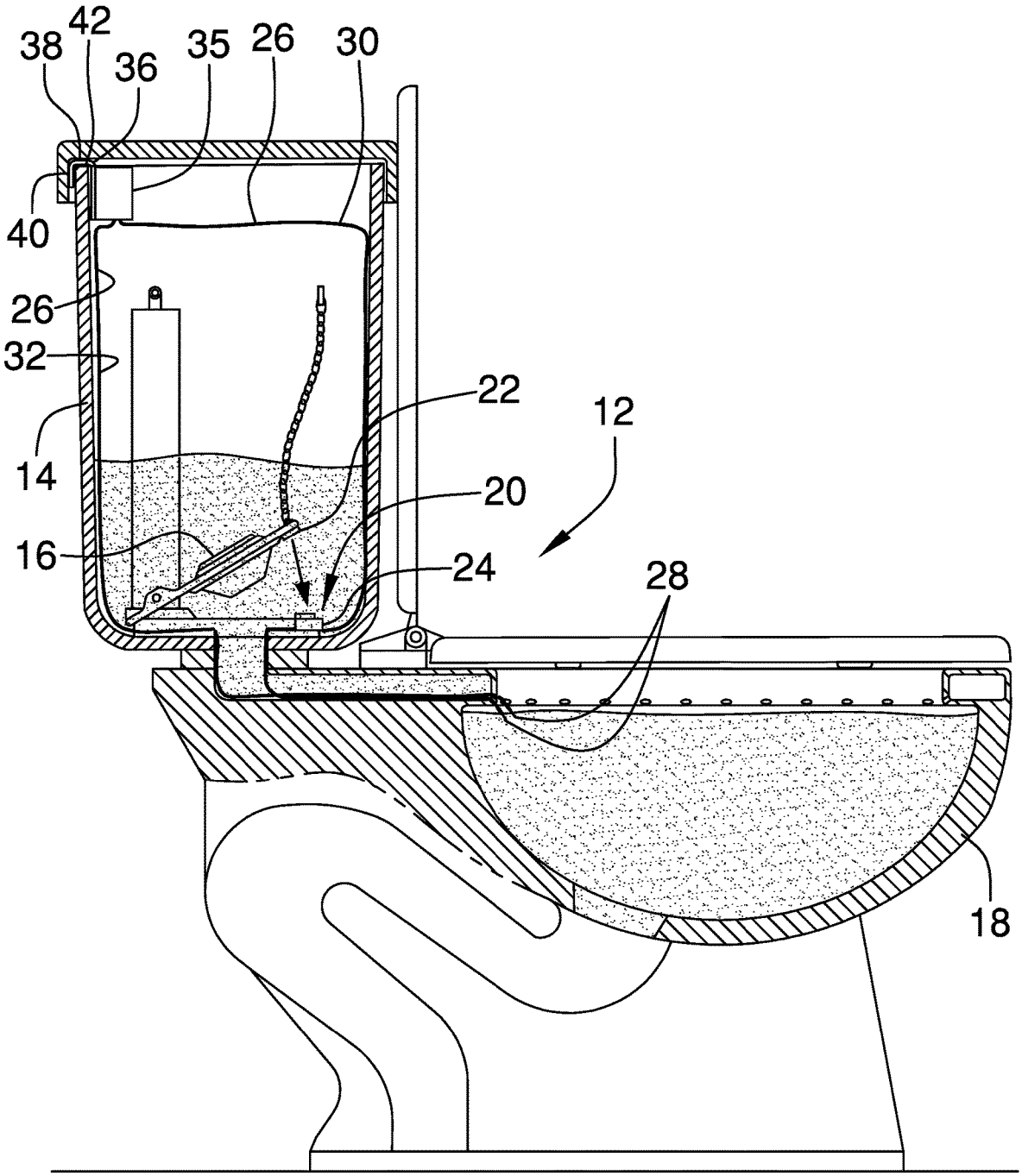
FIG. 4 is a right side cut-away view of an embodiment of the disclosure showing a closure unit being turned on to inhibit a toilet from overflowing.

With reference now to the drawings, and in particular to FIGS. 1 through 4 thereof, a new overflow device embodying the principles and concepts of an embodiment of the disclosure and generally designated by the reference numeral 10 will be described.

As best illustrated in FIGS. 1 through 4, the overflow prevention system 10 generally comprises a toilet 12 that has a tank 14, a flapper 16 and a bowl 18. The toilet 12 may be a plumbed toilet of any conventional design, including residential toilets, commercial toilets and institutional toilets. A closure unit 20 is positioned in the tank 14 of a toilet 12 and the closure unit 20 is aligned with the flapper 16 in the toilet 12 tank 14. The closure unit 20 engages the flapper 16 when the closure unit 20 is turned on to inhibit the flapper 16 from opening. In this way the closure unit 20 inhibits the toilet 12 from overflowing when the toilet 12 is flushed.

The closure unit 20 comprises an engagement 22 that is integrated into the flapper 16. Additionally, the engagement 22 is comprised of a ferromagnetic material. The closure unit 20 includes an electromagnet 24 that is positioned in the tank 14 and the electromagnet 24 is aligned with the flapper 16. The electromagnet 24 magnetically engages the engagement 22 when the electromagnet 24 is turned on to inhibit the flapper 16 from opening. In this manner the electromagnet 24 inhibits the toilet 12 from flushing.

A pair of conductors 26 is included and each of the conductors 26 has an exposed end 28 that is positioned in the bowl 18. The exposed end 28 of each of the conductors 26 is positioned adjacent to a top edge of the bowl 18. Thus, the exposed end 28 of each of the conductors 26 is exposed to water 29 when the bowl 18 of the toilet 12 becomes filled with water 29. The conductors 26 are in electrical communication with the closure unit 20 and the closure unit 20 is turned on when a circuit is completed between the exposed end 28 of the conductors 26. In this way the closure unit 20 can inhibit the bowl 18 of the toilet 12 from overflowing when the toilet 12 is flushed. The pair of conductors 26 includes a first conductor 30 and a second conductor 32, and the first conductor 30 is electrically coupled to the electromagnet 24.

A power supply 34 is provided and the power supply 34 is positioned in the tank 14 of the toilet 12. Each of the first conductor 30 and the second conductor 32 is electrically coupled to the power supply 34. The first conductor 30 extends from the power supply 34 through the electromagnet 24 and into the bowl 18, and the second conductor 32 extends from the power supply 34 to the bowl 18. The power supply 34 comprises a housing 35 that is positionable in the tank 14.

The power supply 34 includes a hook 36 that is coupled to and extends upwardly from the housing 35. The hook 36 includes a leg 38 extending laterally away from the housing 35 and a foot 40 extending downwardly along the housing 35. The leg 38 rests on a top edge 42 of the tank 14 having the foot 40 extending downwardly along an outer surface 44 of the tank 14. In this way the housing 35 is suspended from the top edge 42 of the tank 14. The power supply 34 includes at least one battery 46 that is positioned in the housing 35, and each of the first conductor 30 and the second conductor 32 is electrically coupled to the at least one battery.

In use, the circuit is completed between the exposed end 28 of the first conductor 30 and the second conductor 32 when the toilet bowl 18 becomes filled with water. Thus, the electromagnet 24 is turned on to magnetically engage the engagement 22 in the flapper 16. In this way the flapper 16 is closed to stop the flow of water into the bowl 18. Thus, the toilet bowl 18 is inhibited from overflowing. The circuit between the exposed end 28 of the first conductor 30 and the second conductor 32 is broken when the water in the bowl 18 drains. In this way the flapper 16 is free to move normally for flushing.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An overflow prevention system comprising:

a toilet having a tank, a flapper and a bowl;

a closure unit being positioned in said tank of toilet, said closure unit being aligned with said flapper in the tank, said closure unit engaging said flapper when said closure unit is turned on to inhibit said flapper from opening wherein said closure unit is configured to inhibit said toilet from overflowing when said toilet is flushed; and a pair of conductors, each of said conductors having an exposed end being positioned in said bowl wherein said exposed end of each of said conductors is configured to be exposed to water when said bowl of said toilet becomes filled with water, said conductors being in electrical communication with said closure unit, said closure unit being turned on when a circuit is completed between said exposed ends of said conductors wherein said closure unit is configured to inhibit said bowl of said toilet from overflowing when said toilet is flushed; and wherein said closure unit comprises an engagement being integrated into said flapper, said engagement being comprised of a ferromagnetic material.

2. The system according to claim 1, wherein said closure unit includes an electromagnet being positioned in said tank, said electromagnet being aligned with said flapper, said electromagnet magnetically engaging said engagement when said electromagnet is turned on to inhibit said flapper from opening Wherein said electromagnet is configured to inhibit the toilet from overflowing when said toilet is flushed.

3. The system according to claim 2, wherein said pair of conductors includes a first conductor and a second conductor, said first conductor being electrically coupled to said electromagnet.

4. The system according to claim 3, further comprising a power supply being positioned in said tank of said toilet, said power supply having each of said first conductor and said second conductor being electrically coupled thereto, said first conductor extending from said power supply through said electromagnet and into said bowl, said second conductor extending from said power supply to said bowl.

5. The system according to claim 4, wherein said power supply comprises:

a housing being positionable in said tank;

a hook being coupled to and extending upwardly from said housing, said hook including a leg extending laterally away from said housing and a foot extending downwardly along said housing, said leg resting on a top edge of said tank, said foot extending downwardly along an outer surface of said tank for suspending said housing from said top edge of said tank; and at least one battery being positioned in said housing, each of said first conductor and said second conductor being electrically coupled to said at least one battery.

6. An overflow prevention system comprising:

a toilet having a tank, a flapper and a bowl;

a closure unit being positioned in said tank of a toilet, said closure unit being aligned with said flapper in the tank, said closure unit engaging said flapper when said closure unit is turned on to inhibit said flapper from opening wherein said closure unit is configured to inhibit said toilet from overflowing when said toilet is flushed, said closure unit comprising:

an engagement being integrated into said flapper, said engagement being comprised of a ferromagnetic material; and an electromagnet being positioned in said tank, said electromagnet being aligned with said flapper, said electromagnet magnetically engaging said engagement when said electromagnet is turned on to inhibit said flapper from opening wherein said electromagnet is configured to inhibit the toilet from overflowing when said toilet is flushed;

a pair of conductors, each of said conductors having an exposed end being positioned in said bowl wherein said exposed end of each of said conductors is configured to be exposed to water when said bowl of said toilet becomes filled with water, said conductors being in electrical communication with said closure unit, said closure unit being turned on when a circuit is completed between said exposed ends of said conductors wherein said closure unit is configured to inhibit said bowl of said toilet from overflowing when said toilet is flushed, said pair of conductors including a first conductor and a second conductor, said first conductor being electrically coupled to said electromagnet; and a power supply being positioned in said tank of said toilet, said power supply having each of said first conductor and said second conductor being electrically coupled thereto, said first conductor extending from said power supply through said electromagnet and into said bowl, said second conductor extending from said power supply to said bowl, said power supply comprising:

a housing being positionable in said tank;

a hook being coupled to and extending upwardly from said housing, said hook including a leg extending laterally away from said housing and a foot extending downwardly along said housing, said leg resting on a top edge of said tank, said foot extending downwardly along an outer surface of said tank for suspending said housing from said top edge of said tank; and at least one battery being positioned in said housing, each of said first conductor and said second conductor being electrically coupled to said at least one battery.

* * * * *